United States Patent [19]

Jeschke

[11] Patent Number: 4,712,476

[45] Date of Patent: Dec. 15, 1987

[54] DEVICE FOR SECURING FLEXIBLE PRINTING PLATES UNDER TENSION ON A PLATE CYLINDER OF A ROTARY PRINTING MACHINE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 19,875

[22] Filed: Feb. 27, 1987

[30] Foreign Application Priority Data

Feb. 27, 1986 [DE] Fed. Rep. of Germany ..... 3606351

[51] Int. Cl.[4] ..... B41F 27/12

[52] U.S. Cl. ..... 101/415.1; 101/378

[58] Field of Search ..... 101/415.1, 378

[56] References Cited

U.S. PATENT DOCUMENTS 3,903,796 9/1975 Jeschke et al. ..... 101/415.1

4,596,188 6/1986 Bonomi ..... 101/415.1

*Primary Examiner*—Edgar S. Burr

*Assistant Examiner*—Joseph McCarthy

*Attorney, Agent, or Firm*—Herbert L. Lerner; Laurence A. Greenberg

[57] ABSTRACT

A device for securing flexible printing plates under tension on a plate cylinder of a rotary printing machine having tensioning rails operatively associated with both ends of the plate and being braceable against side walls of a transverse channel formed in the plate cylinder for tensioning the printing plate includes a device for selectively stretching and compressing at least one of the ends of a printing plate in axial direction of the plate cylinder, the tensioning rail operatively associated with the one plate end being of one-piece construction and having a clamping member disposed at a middle region thereof and respective tensioning segments disposed at end regions thereof and actuable for stretching and compressing the one plate end.

9 Claims, 4 Drawing Figures

DEVICE FOR SECURING FLEXIBLE PRINTING PLATES UNDER TENSION ON A PLATE CYLINDER OF A ROTARY PRINTING MACHINE

The invention relates to a device for clamping or securing flexible printing plates under tension on a plate cylinder of a rotary printing machine having tensioning rails, which are operatively associated with or assigned to both ends of the plate and are braceable against side walls of a channel formed in the cylinder for tensioning the printing plate, and having means for stretching or compressing at least one of the plate ends in axial direction of the plate cylinder, such as the trailing plate end, especially.

Such a device is known from U.S. Pat. No. 3,903,796, of which applicant is a joint inventor, in which two pairs of tensioning rails are assigned to a trailing plate end and enable the trailing end of the printing plate to be deformed by means of adjusting screws. These two pairs of tensioning rails are movable circumferentially in order to tension the printing plate, as well as in axial direction of the plate cylinder. Thus, it is possible to stretch the trailing plate end, e.g. in the case of so-called "narrow printing", so that an exact register is obtainable. With the rear tensioning rail being divided, however, in practical operation, it is difficult to prevent a tensioning rail formed of several sections from buckling.

Starting from this state of the prior art, it is an object of the invention to provide a device for securing flexible printing plates under tension on a plate cylinder in such a way that the tensioning as well as the stretching and compressing or contracting of the trailing plate end can be performed in a relatively simple manner, without affecting the practical operation of the printing machine.

With the foregoing and other objects in view, there is provided, in accordance with the invention, a device for securing flexible printing plates under tension on a plate cylinder of a rotary printing machine having tensioning rails operatively associated with both ends of the plate and being braceable against side walls of a transverse channel formed in the plate cylinder for tensioning the printing plate, comprising means for selectively stretching and compressing at least one of the ends of a printing plate in axial direction of the plate cylinder, the tensioning rail operatively associated with the one plate end being of one-piece construction and having a clamping member disposed at a middle region thereof and respective tensioning segments disposed at end regions thereof and actuable for stretching and compressing the one plate end.

Due to this one-piece construction of the tensioning rail, a great stability is attained so that the tensioning rail can be adjusted circumferentially for tensioning the printing plate as well as laterally, without causing problems. Thereby, uniform mounting and tensioning of the printing plate on the plate cylinder is assured so that when the printing plate is secured under tension, the trailing end of the plate can be stretched or contracted i. e. compressed, by means of the tensioning segments. The clamping member provided in the middle region of the tensioning rail avoids any unintended lateral displacement of the plate end so that the adjusted register is reliably maintained. Due to the arrangement of the tensioning segments at the end regions of the tensioning rails, the stretching or contracting (compressing) of the plate end is effected over a very extended region of the plate end, so that the plate end is prevented from buckling or tearing.

In accordance with another feature of the invention, the tensioning segments are pivotally fastened by bearing bolts to the one tensioning rail and are formed with clamping surfaces extending eccentrically to the bearing bolt for engaging respective surfaces of the one plate end.

In accordance with a further feature of the invention, there are provided respective servomotors pivotally mounted on the one tensioning rail for pivoting the tensioning segments.

In accordance with an additional feature of the invention, there are provided thrust bearings embedded in the one tensioning rail opposite the clamping surfaces of the tensioning segments, the thrust bearings supporting the one plate end for movement in axial direction of the plate cylinder.

In accordance with an added feature of the invention, the thrust bearings are formed of polyurethane and are provided with slits extending transversely to the moving direction of the tensioning segments.

In accordance with again another feature of the invention, the thrust bearings are mounted on needle bearings for axial displacement with respect to the plate cylinder.

In accordance with again a further feature of the invention, the clamping surfaces of the tensioning segments are coated with a sharp-edged corundum layer.

In accordance with again an additional feature of the invention, the clamping member is formed of polyurethane, and there are included set screws braceable against the one tensioning rail via a bearing so as to engage with the clamping member.

In accordance with a concomitant feature of the invention, the one plate end is the trailing end of the plate.

Other features which are considered as characteristic for the invention are set forth in the appended claims.

Although the invention is illustrated and described herein as embodied in a device for securing flexible printing plates under tension on a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
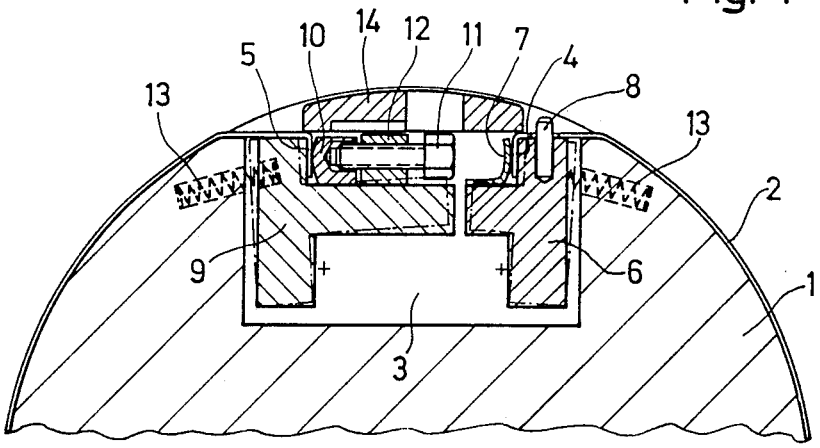
FIG. 1 is a fragmentary cross-sectional view of the device according to the invention taken along the line 1—1 in FIG. 4.

Referring now to the drawing and, first, particularly to FIG. 1 thereof, there is shown, in a fragmentary cross-sectional view, a plate cylinder 1 of a sheet-fed offset printing machine carrying a flexible printing plate in a conventional manner which is tensioned via tensioning means. A cylinder channel 3 extending over the length of the cylinder body of the plate cylinder 1 serves to receive the tensioning means therein. The leading plate end 4 and the trailing plate end 5 are formed with an angle in register in a bending device. For tensioning the plate 2, the leading plate end 4 is suspended from or hooked around a tensioning rail 6 and held in place by a spring 7. Fitting pins 8 serve for exactly aligning the leading plate end 4. The instant the leading plate end 4 is clamped, the plate cylinder 1 is turned through one revolution for mounting the printing plate 2 so that the trailing plate end 5 can also be suspended from or hooked onto a tensioning rail 9. At a middle region of the tensioning rail 9, a clamping member 10 is provided which is preferably formed of polyurethane, is engageable with the angled portion of the trailing plate end 5 by means of adjusting screws 11 which are braced against the tensioning rail 9 via a bearing 12 and clamps the angled portion of the trailing plate end 5. Thereafter, the printing plate 2 is tensioned or tautened on the plate cylinder 1 by compression springs 13 so that both tensioning rails 6 and 9 are moved into the positions illustrated in solid lines in FIG. 1. In the case at hand, both plate ends 4 and 5 are located under a cover plate 14 which prevents the plate ends 4 and 5 from slipping out. The position of the tensioning rail 6 in untensioned or relaxed condition is indicated in phantom in FIG. 1.

Figure 2:
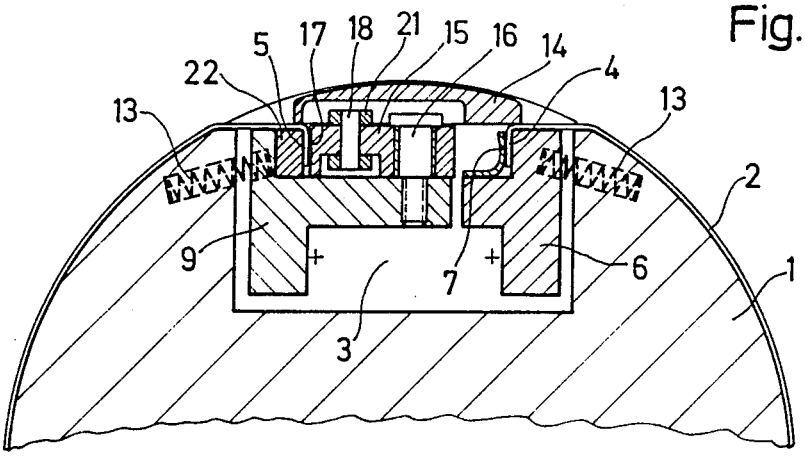
FIG. 2 is a fragmentary cross-sectional view of the device according to the invention taken along the line 2'2 in FIG. 4.
Figure 3:
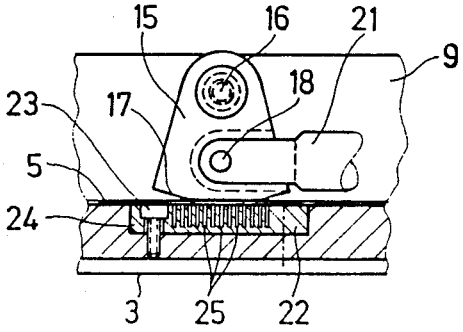
FIG. 3 is a fragmentary top plan view of FIG. 2 rotated 90° counterclockwise, partly in section and with a cover plate 14 removed, showing a lateral tensioning device forming part of the invention.

FIGS. 2 and 3 show tensioning segments 15 provided on both sides of the tensioning rail 9 at end or outer regions thereof and being pivotally fastened to the tensioning rail 9 by bearing bolts 16. Facing towards the plate end 5, each of the tensioning segments 15 are formed with a clamping surface 17 which extends eccentrically with respect to a respective bearing bolt 16 and has a neutral middle position (as indicated). When the tensioning segment 15 is pivoted about the bearing bolt 16 to the right-hand side or to the left-hand side, as viewed in FIG. 3, the plate end 5 is initially clamped, due to the eccentric construction of the clamping surface 17, and is thereafter slightly displaced in axial direction of the plate cylinder 1 so that the plate end 5 is either stretched or compressed. The inclination of the eccentric clamping surface 1 to the plate end 5 produces an additional clamping force during the stretching and compressing or contracting of the plate end 5 and has a self-locking effect.

Figure 4:
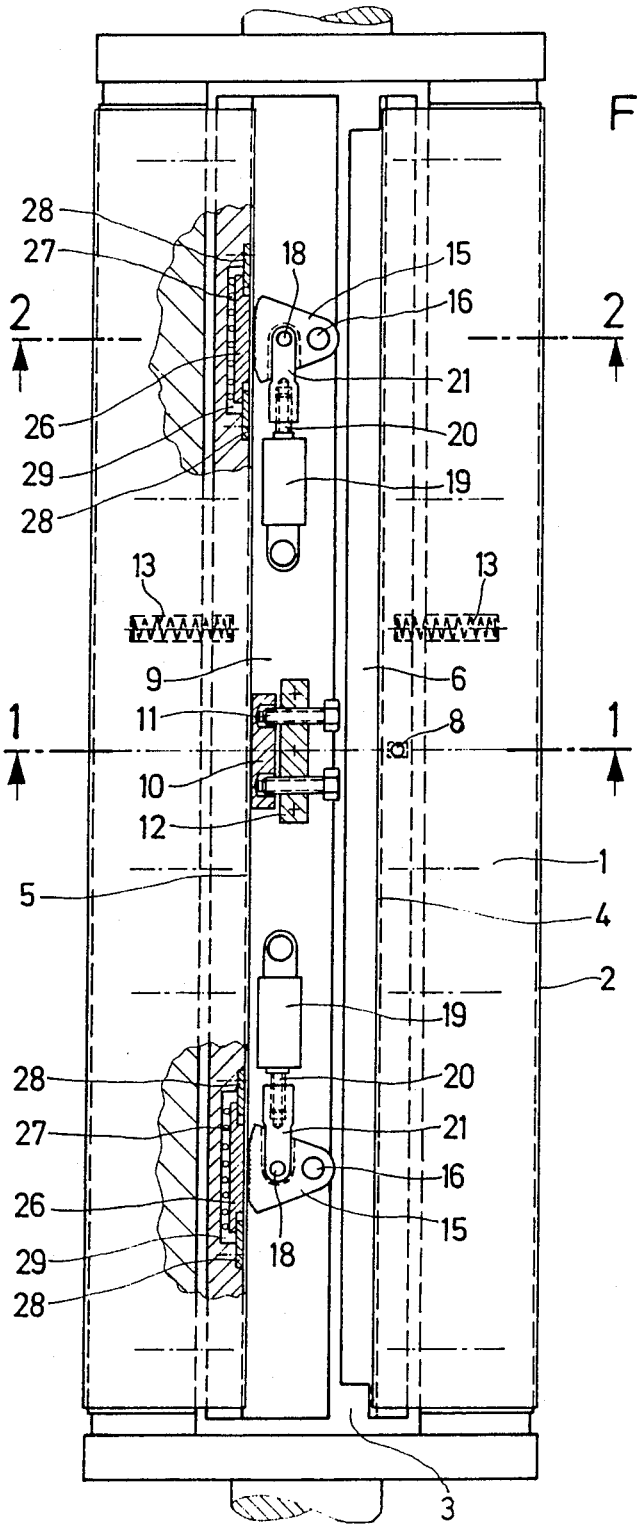
FIG. 4 is a top plan view of the plate cylinder and another embodiment of the device according to the invention.

An adjusting device engages the respective tensioning segment 15 via a bolt 18 for the purpose of laterally pivoting the respective tensioning segment 15. In a relatively simplified construction, this adjusting device is made up of an adjusting screw or setscrew which may be turned by hand. In contrast therewith, FIGS. 2 through 4 illustrate an adjusting motor or servomotor 19 which causes pivoting of the tensioning segment 15 via a threaded pin or screw 20 and a forked lever 21. If the adjustment is performed manually, the plate end 5 is stretched or compressed when the machine is at rest, and if the adjustment is effected by motor, this operation is carried out while the machine is either at rest or in operation. In order to ensure an exact adjustment of the tensioning segments 15, the clamping surfaces 17 thereof can be coated with a sharp-edged or angular corundum layer.

In FIG. 3, a thrust bearing 22 is mounted by screws 23, below the plate end 5, in a recess 24 formed in the tensioning rail 9 and opposite the clamping surface 17 of the tensioning segment 15. This thrust bearing 22 may be formed of polyurethane and with slits 25 extending transversely to the direction of movement of the tensioning segments 15. The thrust bearings 22 support the laterally moving plate end 5 while it is being stretched or compressed.

FIG. 4 shows a different thrust bearing 26 serving the same purpose as that of the thrust bearing 22 of FIG. 3 but being mounted on needle bearings 27. The thrust bearing 26 is retained in the recess 29 by holders or retainers 28 so that it may be longitudinally displaceable.

In the illustrated embodiments normally both tensioning segments 15 are uniformly pivoted to a relatively slight extent depending upon how much the trailing plate end 5 is being corrected. Clamping the plate end 5 with the clamping member 10 also permits a one-sided correction, when required or desired, by actuating only one tensioning segment 15. Irrespective of this fact, due to the stable one-piece mounting of the tensioning rail 9, any desired adjustment thereof can be performed by the pressman without undesirably affecting the tensioning quality.

The foregoing is a description corresponding in substance to German Application No. P 36 06 351.7, dated Feb. 27, 1986, the International priority of which is being claimed for the instant application, and which is hereby made part of this application. Any material discrepancies between the foregoing specification and the aforementioned corresponding German application are to be resolved in favor of the latter.

I claim:

1. In combination with a plate cylinder having a transverse channel, with sidewalls, formed therein, a device for securing a flexible printing plate under tension on the plate cylinder, a tensioning rail operatively associated with each end of the plate and being braceable against the side walls of the transverse channel formed in the plate cylinder for tensioning the printing plate, comprising means for selectively stretching and/or compressing at least one of the ends of a printing plate in the axial direction of the plate cylinder, the tensioning rail operatively associated with the one plate end being of one-piece construction and having a clamping member disposed at a middle region thereof and respective tensioning segments disposed at end regions thereof and means to selectively actuate the tensioning segments, for stretching and/or compressing the one plate end.

2. Device according to claim 1, wherein said tensioning segments are pivotally fastened by bearing bolts to the one tensioning rail associated with said at least one end and are formed with clamping surfaces extending eccentrically to the bearing bolt for engaging respective surfaces of the one plate end.

3. Device according to claim 2, wherein respective servomotors pivotally mounted on the one tensioning rail associated with said at least one end for pivoting said tensioning segments.

4. Device according to claim 2, including thrust bearings embedded in the one tensioning rail associated with said at least one end opposite said clamping surfaces of said tensioning segments, said thrust bearings supporting the one plate end for movement in axial direction of the plate cylinder.

5. Device according to claim 4, wherein said thrust bearings are formed of polyurethane and are provided with slits extending transversely to the moving direction of the tensioning segments.

6. Device according to claim 4, wherein said thrust bearings are mounted on needle bearings for axial displacement with respect to the plate cylinder.

7. Device according to claim 2, wherein said clamping surfaces of said tensioning segments are coated with a sharp-edged corundum layer.

8. Device according to claim 1, wherein said clamping member is formed of polyurethane, and including set screws braceable against the one tensioning rail via a bearing so as to engage with said clamping member.

9. Device according to claim 1, wherein said one plate end is the trailing end of the plate.

* * * * *